US009985351B2

(12) United States Patent
Kim et al.

(10) Patent No.: US 9,985,351 B2
(45) Date of Patent: May 29, 2018

(54) MULTI-BAND ANTENNA AND ELECTRONIC DEVICE FOR SUPPORTING THE SAME

(71) Applicant: Samsung Electronics Co., Ltd., Gyeonggi-do (KR)

(72) Inventors: Jong Suk Kim, Gyeonggi-do (KR); Jin Kyu Bang, Gyeonggi-do (KR); Kyung Bae Ko, Gyeonggi-do (KR); Dong Hwan Kim, Gyeonggi-do (KR)

(73) Assignee: Samsung Electronics Co., Ltd (KR)

( * ) Notice: Subject to any disclaimer, the term of this patent is extended or adjusted under 35 U.S.C. 154(b) by 68 days.

(21) Appl. No.: 14/808,667

(22) Filed: Jul. 24, 2015

(65) Prior Publication Data

US 2016/0028157 A1 Jan. 28, 2016

(30) Foreign Application Priority Data

Jul. 24, 2014 (KR) ..... 10-2014-0094171

(51) Int. Cl.

| | |
|---|---|
| ***H01Q 5/00*** | (2015.01) |
| ***H01Q 5/371*** | (2015.01) |
| ***H01Q 5/335*** | (2015.01) |
| ***H01Q 1/24*** | (2006.01) |
| ***H01Q 21/28*** | (2006.01) |

(52) U.S. Cl.

CPC ..... *H01Q 5/371* (2015.01); *H01Q 1/243* (2013.01); *H01Q 5/335* (2015.01); *H01Q 21/28* (2013.01)

(58) Field of Classification Search

CPC ..... H01Q 5/371; H01Q 5/335; H01Q 1/243; H01Q 21/28

USPC ..... 343/852

See application file for complete search history.

(56) References Cited

U.S. PATENT DOCUMENTS

| | | | | |
|---|---|---|---|---|
| 2007/0273606 | A1* | 11/2007 | Mak | H01Q 1/243 343/876 |
| 2013/0099996 | A1* | 4/2013 | Tseng | H01Q 1/243 343/876 |
| 2013/0122828 | A1 | 5/2013 | Choi | |
| 2013/0135150 | A1* | 5/2013 | Kenoun | H01Q 9/0421 343/700 MS |
| 2014/0320359 | A1* | 10/2014 | Wong | H01Q 5/35 343/749 |
| 2015/0084817 | A1* | 3/2015 | Yong | H01Q 1/243 343/702 |

FOREIGN PATENT DOCUMENTS

| | | |
|---|---|---|
| KR | 10-2013-0053801 | 5/2013 |
| KR | 10-2013-0077362 | 7/2013 |

* cited by examiner

*Primary Examiner* — Dameon E Levi
*Assistant Examiner* — David Lotter
(74) *Attorney, Agent, or Firm* — The Farrell Law Firm, P.C.

(57) ABSTRACT

A multi-band antenna is provided. The multi-band antenna includes a plurality of radiator patterns that are configured to operate according to different frequency bands, a plurality of feeding units that are respectively connected to different contact points of the antenna radiator for connecting feeding units of the plurality of feeding units to at least one radiator pattern included in the plurality of radiator patterns, and a switching unit configured to switch between feeding units of the plurality of feeding units for connecting at least one radiator pattern included in the plurality of radiator patterns to the switched feeding unit.

13 Claims, 12 Drawing Sheets

| | B4 | B1 | B2/B6 | B3 | B5 |
|---|---|---|---|---|---|
| SELECTION OF FIRST FEEDING UNIT | - | 15% | 24% | 25% | - |
| SELECTION OF SECOND FEEDING UNIT | 12% | - | 25% | - | 20% |

B1:925~960MHz
B2:1570~1580MHz
B3:2110~2690MHz
B4:869~894MHz
B5:2620~2690MHz
B6:1570~1580MHz

FIG.6B

MULTI-BAND ANTENNA AND ELECTRONIC DEVICE FOR SUPPORTING THE SAME

PRIORITY

This application claims priority under 35 U.S.C. § 119(a) to Korean Patent Application Serial No. 10-2014-0094171, which was filed in the Korean Intellectual Property Office on Jul. 24, 2014, the entire disclosure of which is incorporated herein by reference.

BACKGROUND OF THE INVENTION

1. Field of the Invention

The present invention relates to an antenna corresponding to frequencies of a multi-band, and more particularly, to an electronic device that includes an antenna capable of retaining a specific frequency band before and after switching through a feeding unit switching structure.

2. Description of the Related Art

With the development of wireless communication technologies, a frequency and a frequency band for use in a wireless communication device may increase, and the number of antennas for coping with corresponding frequencies may increase. A shortage of an antenna mounting space in an electronic device may restrict a configuration of an antenna, thereby needing an antenna operating at various frequency bands.

FIGS. 1A and 1B are diagrams illustrating an antenna and an input reflection coefficient graph, according to the related art. Referring to FIG. 1A, a switch structure may be added to a ground unit such that an antenna with the same radiator pattern is changed in the forms corresponding to different frequency bands. The antenna of FIG. 1 may selectively use a plurality of frequency bands through a switch change, but may not retain a signal of a specific frequency band before and after the switch change. For example, referring to FIG. specific frequency band before and after the switch change. For example, referring to FIG. 1B, an antenna according to the related art may operate in response to a GPS signal before switching and may not operate in response to the GPS signal after switching (an increase in an input reflection coefficient at a GPS signal band).

SUMMARY OF THE INVENTION

The present invention has been made to address at least the above-mentioned problems and/or disadvantages and to provide at least the advantages described below. Accordingly, an aspect of the present invention is to provide a multi-band antenna and an electronic device supporting the same, capable of retaining a specific frequency band (e.g., a GPS signal band) before and after switching through a feeding unit switching structure.

In accordance with an aspect of the present invention, there is provided a multi-band antenna. The multi-band antenna includes an antenna radiator including a plurality of radiator patterns configured to operate according to different frequency bands, a plurality of feeding units respectively connected to different contact points of the antenna radiator for connecting feeding units of the plurality of feeding units to at least one radiator pattern included in the plurality of radiator patterns, and a switching unit configured to switch between feeding units of the plurality of feeding units for connecting at least one radiator pattern included in the plurality of radiator patterns to the switched feeding unit. Even though a feeding unit is changed by the switching unit, at least one of the different frequency bands is retained without modification.

In accordance with an aspect of the present invention, there is provided an electronic device which includes a multi-band antenna. The multi-band antenna includes an antenna radiator including a plurality of radiator patterns configured to operate according to different frequency bands, a plurality of feeding units respectively connected to different units to at least one radiator pattern included in the plurality of radiator patterns, and a switching unit configured to switch between feeding units of the plurality of feeding units for connecting at least one radiator pattern included in the plurality of radiator patterns to the switched feeding unit. Even though a feeding unit is changed by the switching unit, at least one of the different frequency bands is retained without modification.

BRIEF DESCRIPTION OF THE DRAWINGS

The above and other aspects, features, and advantages of certain embodiments of the present invention will be more apparent from the following description taken in conjunction with the accompanying drawings, in which:

FIG. 6A is a graph illustrating a variation in an input reflection coefficient due to a frequency variation and FIG. 6B is a table of digitized antenna communication efficiencies before and after changing of a feeding unit, according to an embodiment of the present invention;

Throughout the drawings, it should be noted that like reference numbers are used to depict the same or similar elements, features, and structures.

DETAILED DESCRIPTION OF EMBODIMENTS OF THE PRESENT INVENTION

Figure 1A:
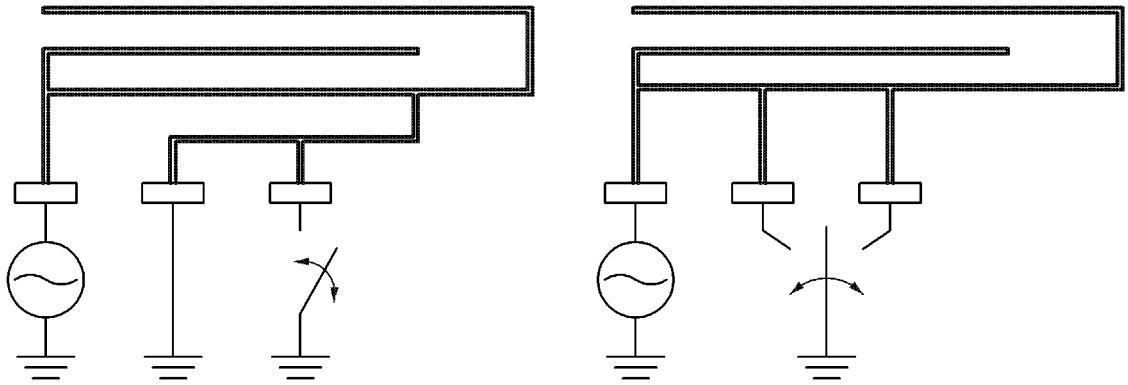
FIG.1A (RELATED ART)
FIGS. 1A and 1B are diagrams illustrating an antenna and an input reflection coefficient graph, according to the related art.
Figure 1B:
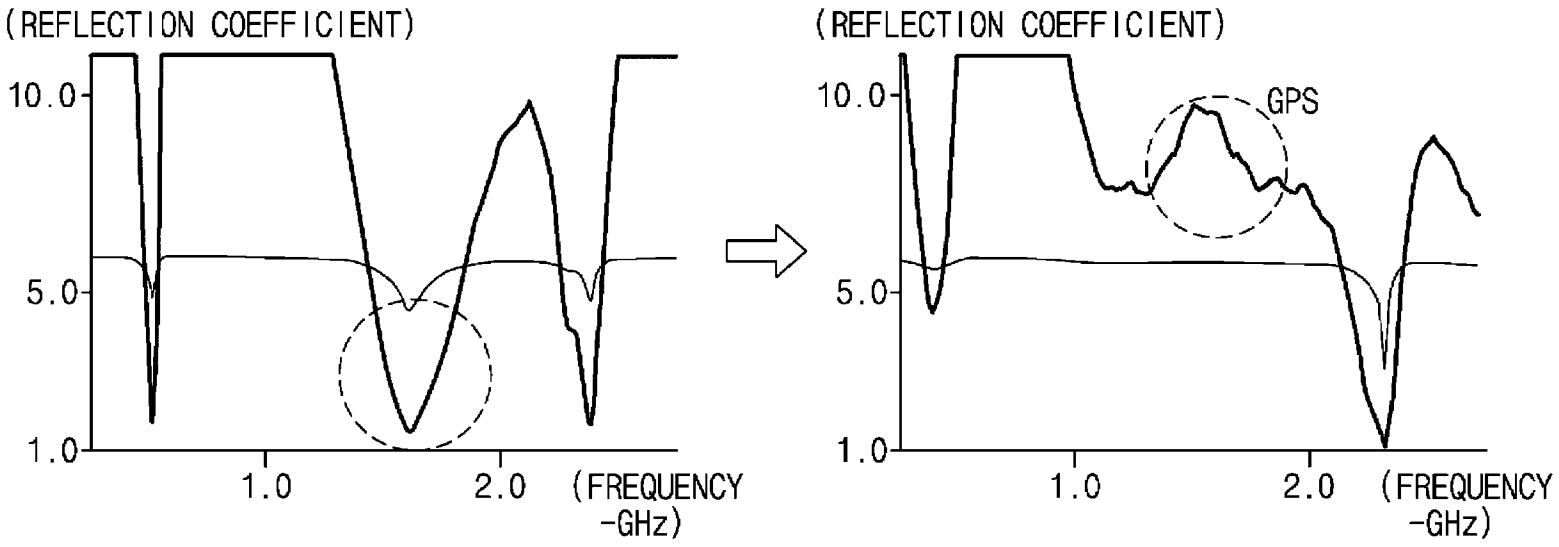
FIG.1B (RELATED ART)

The following description with reference to the accompanying drawings is provided to assist in a comprehensive understanding of various embodiments of the present invention as defined by the claims and their equivalents. It includes various specific details to assist in that understanding but these are to be regarded merely as examples. Accordingly, those of ordinary skill in the art will recognize that various changes and modifications of the various embodiments described herein can be made without departing from the scope and spirit of the present invention. In addition, descriptions of well-known functions and constructions may be omitted for clarity and conciseness.

The terms "include," "comprise," "including," or "comprising" used herein indicate disclosed functions, operations, or existence of elements but do not exclude other functions, operations or elements. It should be further understood that the terms "include", "comprise", "have", "including", "comprising", or "having" used herein specify the presence of stated features, integers, operations, elements, components, or combinations thereof, but do not preclude the presence or addition of one or more other features, integers, operations, elements, components, or combinations thereof.

The meaning of the terms "or" or "at least one of A and/or B" used herein includes any combination of words listed together with the term. For example, the expression "A or B" or "at least one of A and/or B" may indicate A, B, or both A and B.

Terms, such as "first", "second", and the like used herein may refer to various elements of various embodiments of the present invention, but do not limit the elements. For example, such terms do not limit the order and/or priority of the elements. Furthermore, such terms may be used to distinguish one element from another element. For example, "a first user device" and "a second user device" indicate different user devices. For example, without departing the scope of the present invention, a first element may be referred to as a second element, and similarly, a second element may be referred to as a first element.

In the description below, when one part (or element, device, etc.) is referred to as being "connected" to another part (or element, device, etc.), it should be understood that the former can be "directly connected" to the latter, or "electrically connected" to the latter via an intervening part (or element, device, etc.). It will be further understood that when one component is referred to as being "directly connected" or "directly linked" to another component, it means that no intervening component is present.

The term "module" used herein may represent, for example, a unit including one or more combinations of hardware, software and firmware. The term "module" may be interchangeably used with the terms "unit", "logic", "logical block", "component" and "circuit". The "module" may be a minimum unit of an integrated component or may be a portion thereof. The "module" may be a minimum unit for performing one or more functions or a portion thereof. The "module" may be implemented mechanically or electronically. For example, the "module" according to various embodiments of the present invention may include at least one of an application-specific IC (ASIC) chip, a field-programmable gate array (FPGA), and a programmable-logic device for performing some operations, which are known or will be developed.

Terms used in this specification are used to describe embodiments of the present invention and are not intended to limit the scope of the present invention. The terms of a singular form may include plural forms unless otherwise specified.

Unless otherwise defined herein, all the terms used herein, which include technical or scientific terms, may have the same meaning that is generally understood by a person skilled in the art. It will be further understood that terms, which are defined in a dictionary and commonly used, should also be interpreted as is customary in the relevant related art and not in an idealized or overly formal sense unless expressly so defined herein in various embodiments of the present invention.

Electronic devices according to various embodiments of the present invention may include a device with a communication function. For example, the electronic devices may include, but are not limited to, smartphones, tablet personal computers (PCs), mobile phones, video telephones, electronic book readers, desktop PCs, laptop PCs, netbook computers, personal digital assistants (PDAs), portable multimedia players (PMPs), Motion Picture Experts Group (MPEG-1 or MPEG-2) Audio Layer 3 (MP3) players, mobile medical devices, cameras, wearable devices (e.g., head-mounted-devices (HMDs), such as electronic glasses), an electronic apparel, electronic bracelets, electronic necklaces, electronic appcessories, electronic tattoos, smart watches, and the like.

The electronic devices may be smart home appliances including a communication function. The smart home appliances may include, but are not limited to, televisions (TVs), digital versatile disc (DVD) players, audios, refrigerators, air conditioners, cleaners, ovens, microwave ovens, washing machines, air cleaners, set-top boxes, TV boxes (e.g., Samsung HomeSync™, Apple TV™, or Google TV™), game consoles, electronic dictionaries, electronic keys, camcorders, electronic picture frames, and the like.

The electronic devices may include at least one of medical devices (e.g., a magnetic resonance angiography (MRA), a magnetic resonance imaging (MRI), a computed tomography (CT), scanners, and ultrasonic devices), navigation devices, global positioning system (GPS) receivers, event data recorders (EDRs), flight data recorders (FDRs), vehicle infotainment devices, electronic equipment for vessels (e.g., navigation systems and gyrocompasses), avionics, security devices, head units for vehicles, industrial or home robots, automatic teller's machines (ATMs), and points of sales (POSs).

The electronic devices may include at least one of parts of furniture or buildings/structures having communication functions, electronic boards, electronic signature receiving devices, projectors, and measuring instruments (e.g., water meters, electricity meters, gas meters, and wave meters) including metal cases. The electronic devices may be one or more combinations of the above-mentioned devices. Furthermore, the electronic devices may be flexible devices. It would be obvious to those skilled in the art that the electronic devices according to various embodiments of the present invention are not limited to the above-mentioned devices.

Hereinafter, electronic devices according to various embodiments of the present invention will be described with reference to the accompanying drawings. The term "user" used herein may refer to a person who uses an electronic device or may refer to a device (e.g., an artificial electronic device) that uses an electronic device.

Figure 2:
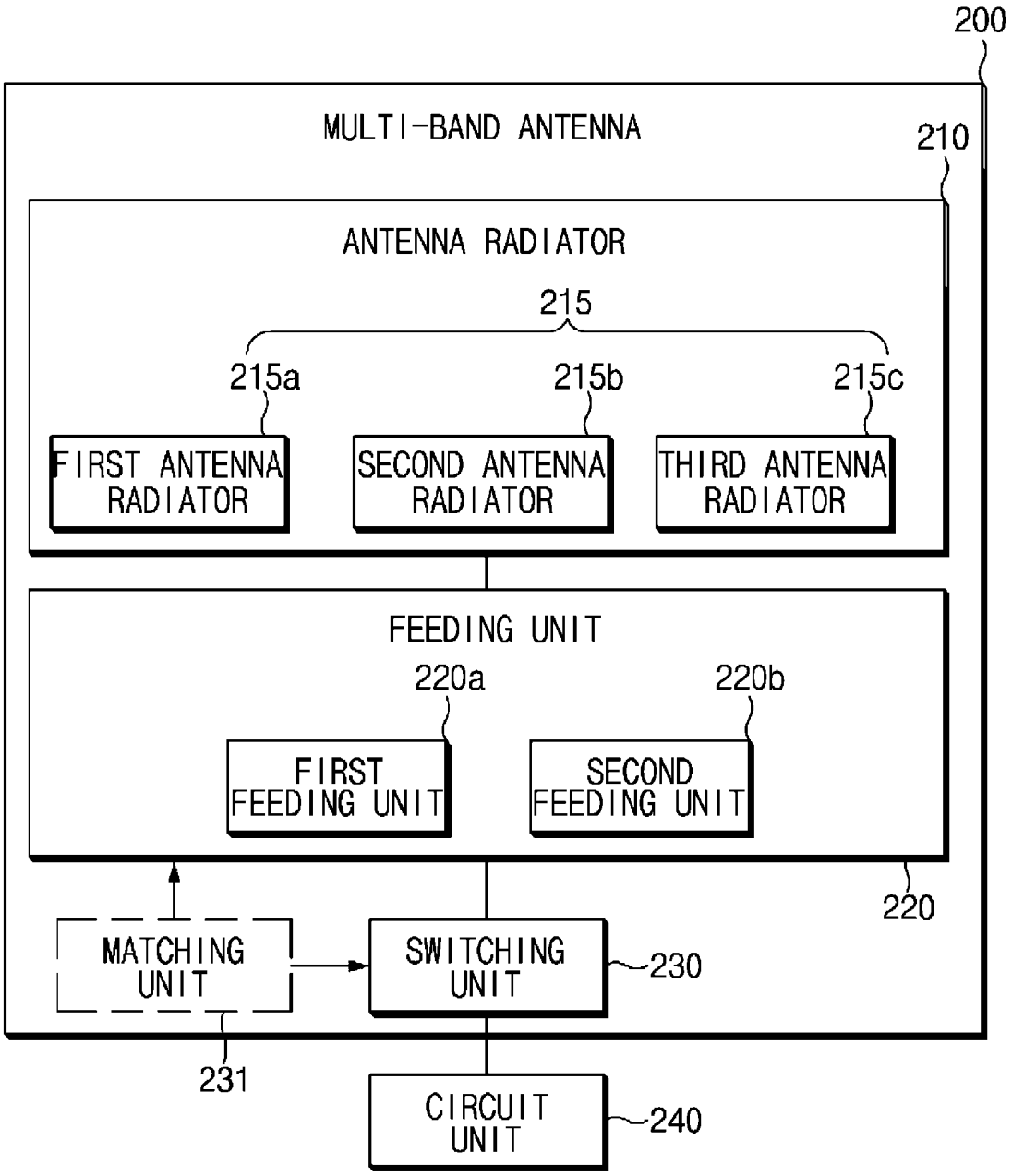
FIG. 2 is a diagram illustrating a block diagram of a multi-band antenna, according to an embodiment of the present invention.

FIG. 2 is a diagram illustrating a multi-band antenna, according to an embodiment of the present invention.

Referring to FIG. 2, a multi-band antenna 200 includes an antenna radiator 210, a plurality of feeding units 220, and a switching unit 230. In FIG. 2, the multi-band antenna 200 may be illustrated as including three radiator patterns or configurations and two feeding units. However, the scope and spirit of the present invention may not be limited thereto. For example, a configuration of the multi-band antenna 200 may vary according to a communication environment or a design environment.

The antenna radiator 210 includes a plurality of radiator patterns 215. Each of the plurality of radiator patterns 215 may have a shape or length suitable to transmit and receive a signal of a frequency band in a specific range. The plurality of radiator patterns 215 may be set to transmit and receive signals corresponding to different frequency bands. For example, shapes or lengths of first to third radiator patterns 215*a* to 215*c* may be adjusted so as to correspond to first to third frequency bands being different from each other.

The plurality of feeding units 220 may be connected to the antenna radiator 210. The plurality of feeding units 220 supply power to the antenna radiator 210 through a contact point coupled with the antenna radiator 210. At least one of the plurality of feeding units 220 may be selected by the switching unit 230. The selected feeding unit may supply power to the antenna radiator 210. A description of the Operation of a multi-band antenna through switching of a feeding unit will be given with reference to FIGS. 3 to 9.

The switching unit 230 may be coupled to the plurality of feeding units 220. The switching unit 230 selects at least one feeding unit, which supplies power to the antenna radiator 210, from among the plurality of feeding units 220. If a feeding unit is changed by the switching unit 230, a position of a contact point where a corresponding feeding unit is coupled with the antenna radiator 210 may also change. In the case where the position of the contact point is changed, a shape or length of each radiator pattern included in the antenna radiator 210 may be also changed. If the shape or length of the radiator pattern is changed, there may be changed a frequency band that is needed for an antenna to transmit and receive signals.

Even though a feeding unit is changed by the switching unit 230, at least one of the frequency bands, corresponding to the plurality of radiator patterns 215 before changing of a feeding unit, may be retained even after changing of a feeding unit. In the case where a first frequency band (e.g., a GPS signal band) is covered by the multi-band antenna 200 before changing of a feeding unit, the first frequency band may be continuously covered through the multi-band antenna 200, even after a feeding unit is changed. For example, a signal of a first frequency band (e.g., a GPS signal band) may be received by the first radiator pattern 215*a* before switching of a feeding unit and may be received by the modified second radiator pattern 215*b* after switching of a feeding unit.

The switching unit 230 may be connected to a circuit unit 240 and may be controlled thereby. For example, the circuit unit 240 may be a radio frequency (RF) module that controls the switching unit 230 using an electrical signal. According to various embodiments of the present disclosure, the circuit unit 240 may be implemented to be independent of a processor (AP) in an electronic device or may be included in the processor.

The multi-band antenna 200 may further include an optional matching unit 231 is in operable communication with the feeding unit 220 and the switching unit 230. The matching unit includes circuitry for monitoring at least one of capacitance, resistance, or reactance or a combination thereof associated with the feeding unit 220 and/or the switching unit 230 for adjusting impedance of the feeding unit 220 and/or the switching unit 230 in such a way that each radiator pattern operates at a specific frequency band.

Figure 3:
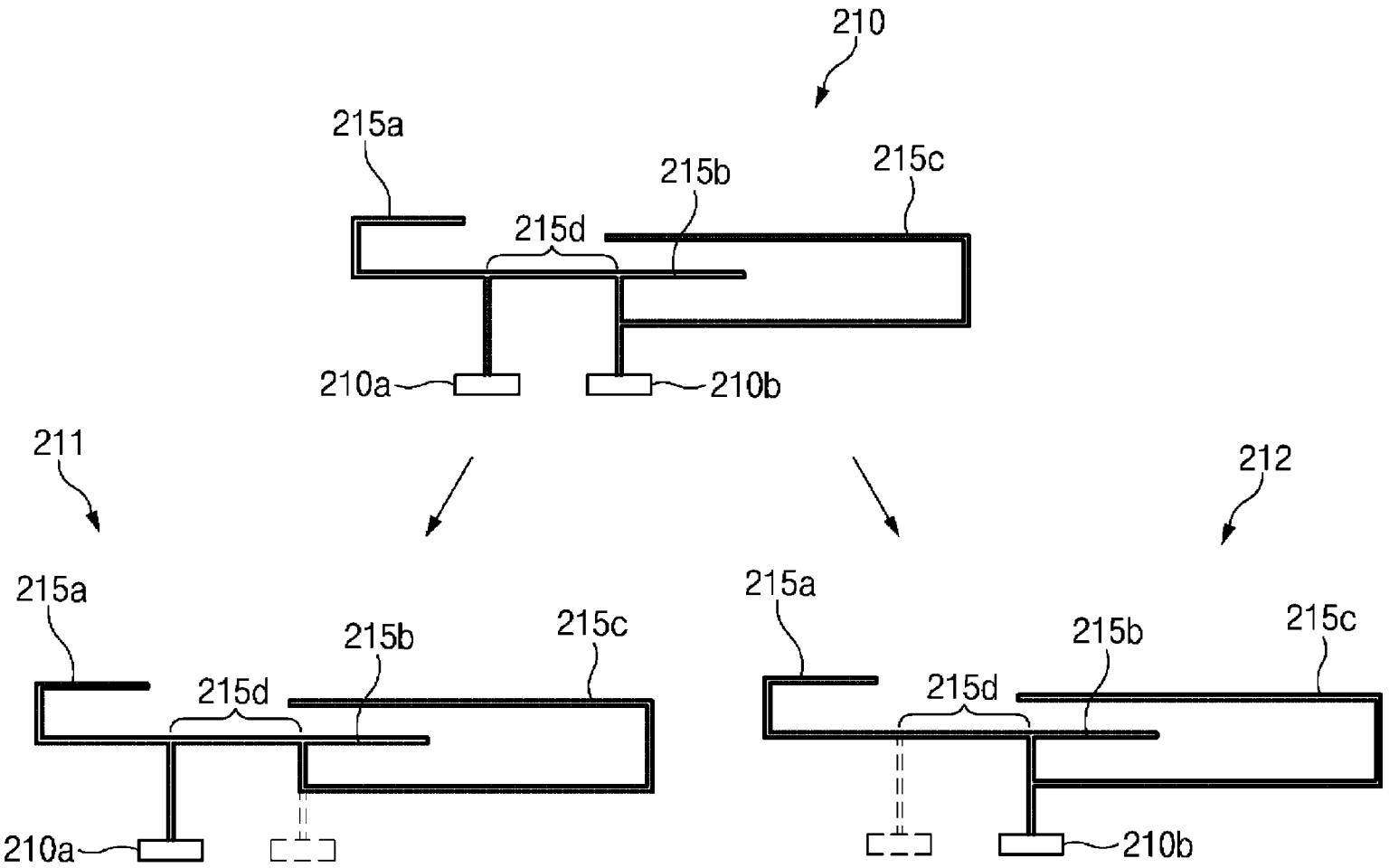
FIG. 3 is a diagram illustrating an antenna radiator, according to an embodiment of the present invention.

FIG. 3 is a diagram illustrating an antenna radiator, according to an embodiment of the present invention.

Referring to FIG. 3, the antenna radiator 210 may include three radiator patterns and two contact points (to which feeding units are connected), but a shape of the antenna radiator 210 may not be limited thereto. For example, a shape of the antenna radiator 210 may vary according to a communication environment or a design environment.

The antenna radiator 210 includes first to third radiator patterns 215*a* to 215*c*. Shapes or lengths of the first to third radiator patterns 215*a* to 215*c* may be adjusted so as to correspond to first to third frequency bands being different from each other. A shape or length of each radiator pattern may vary according to a change of position of a contact point to which power is supplied.

The antenna radiator 210 includes a common pattern 215*d*. The common pattern 215*d* may be a portion of the antenna radiator 210 that is continuously electrically connected with at least one of a first contact point or a second contact point, even though a position of a contact point is changed. A length of the common pattern 215*d* may be adjusted according to an antenna design manner or a corresponding frequency range. Where a position of a contact point to which power is supplied has changed, the antenna radiator 210 may be changed to the configuration illustrated by antenna radiator 211 or antenna radiator 212.

A first contact point 210*a* may be a point where the first feeding unit 220*a* is coupled with the antenna radiator 210. If the first feeding unit 220*a* is selected by the switching unit 230, power may be supplied to the antenna radiator 210 through the first contact point 210*a*.

A second contact point 210*b* may be a point where the second feeding unit 220*b* is coupled with the antenna radiator 210. If the second feeding unit 220*b* is selected by the switching unit 230, power may be supplied to the antenna radiator 210 through the second contact point 210*b*.

The switching unit 230 selects at least one feeding unit, which will supply power to the antenna radiator 210, from among the plurality of feeding units 220. If a feeding unit is changed by the switching unit 230, a position of a contact point to which power is supplied may be changed. Where the switching unit 230 selects the first feeding unit 220*a*, power may be supplied through the first feeding unit 220*a* and the first contact point 210*a*. In contrast, if the switching unit 230 selects the second feeding unit 220*b*, power may be supplied to the antenna radiator 210 through the second feeding unit 220*b* and the second contact point 210*b*. A change of a feeding unit and a contact point for supplying power may cause a change of a shape or length of each radiator pattern included in the antenna radiator 210, and, in some cases, a frequency band corresponding to each radiator pattern may be changed according to such a change.

The antenna radiator 211 corresponds to a case where the first contact point 210*a* is selected by the switching unit 230. Where the switching unit 230 selects the first feeding unit 220*a*, power may be supplied through the first contact point 210*a* where the first feeding unit 220*a* and the antenna radiator 210 are connected. If power is supplied through the first contact point 210*a*, shapes or lengths of the first to third radiator patterns 215*a* to 215*c* may be determined according to a position of the first contact point 210*a*.

The first radiator pattern 215*a* may have a length from the first contact point 210*a* to an end portion of a radiator pattern. Other radiator patterns may have a length from the first contact point 210*a* to an end portion of a respective radiator pattern.

The first to third radiator patterns 215*a* to 215*c* may correspond to first to third frequency bands based on the determined shapes or lengths of the radiator patterns. In this case, the length of the common pattern 215*d* may affect the lengths of the second radiator pattern 215*b* and the third radiator pattern 215*c*. For example, as the length of the common pattern 215*d* becomes longer, the lengths of the second radiator pattern 215*b* and the third radiator pattern 215*c* may become longer too.

The antenna radiator 212 corresponds to the case where the second contact point 210*b* is selected by the switching unit 230. In the case where the switching unit 230 selects the second feeding unit 220*b*, power may be supplied through the second contact point 210*b* where the second feeding unit 220*b* and the antenna radiator 210 are connected. If power is supplied through the second contact point 210*b*, shapes or lengths of the first to third radiator patterns 215*a* to 215*c* may be determined according to a position of the second contact point 210*b*.

The first radiator pattern 215*a* may have a length from the second contact point 210*b* to an end portion of the radiator pattern. Other radiator patterns may have a length from the second contact point 210*b* to an end portion of a respective radiator pattern. In this case, the length of the common pattern 215*d* may affect the length of the first radiator pattern 215*a*. For example, as the length of the common pattern 215*d* becomes longer, the length of the first radiator pattern 215*a* may become longer.

In the antenna radiator 211 and the antenna radiator 212, the lengths of the first to third radiator patterns 215*a* to 215*c* may become shorter or longer according to whether a pattern starting from the first contact point 210*a* or the second contact point 210*b* includes a portion 215*d*, if a contact point to which power is supplied is changed. If the length of the antenna radiator 210 becomes shorter, a resonance point of an antenna may move to a relatively high frequency domain. In contrast, if the length of the antenna radiator 210 becomes longer, a resonance point of an antenna may move to a relatively low frequency domain.

For example, in the antenna radiator 211 and the antenna radiator 212, if a contact point to which power is supplied is changed from the first contact point 210*a* to the second contact point 210*b*, the length of the first radiator pattern 215*a* may increase in comparison with before changing. Where the first radiator pattern 215*a* corresponds to a first frequency band (e.g., 925 to 960 MHz) before a contact point is changed, the first radiator pattern 215*a* may operate at a frequency band (e.g., 869 to 894 MHz) lower than the first frequency band, after a contact point is changed.

The length of the second radiator pattern 215*b* may become shorter if a contact point to which power is supplied is changed from the first contact point 210*a* to the second contact point 210*b*. In the case where the second radiator pattern 215*b* corresponds to a second frequency band (e.g., 1555 to 1575 MHz) before a contact point is changed, the second radiator pattern 215*b* may operate at a frequency band (e.g., 2620 to 2690 MHz) higher than the second frequency band, after a contact point is changed. A frequency band of the third radiator pattern 215*c* may be changed according to a change of a contact point in a similar manner.

Even though a feeding unit is changed by the switching unit 230, at least one frequency band, corresponding to the plurality of radiator patterns 215 before changing, may be retained, even after a feeding unit is changed. For example, first to third frequency bands may be covered by the antenna radiator 210 before switching of a feeding unit, and a second frequency band (a band retained before and after changing of a feeding unit), a fourth frequency band (a separate band different from the first to third frequency bands), and a fifth frequency band (a separate band different from the first to third frequency bands) may be covered by the antenna radiator 210 after switching of a feeding unit. In this case, after a feeding unit is switched, even though a portion of a frequency band, which a multi-band antenna 200 covers, is changed to the fourth frequency band and the fifth frequency band, which are different from the first to third frequency bands, the second frequency band before and after switching of a feeding unit may be continuously covered by the antenna radiator 210 regardless of a change of a feeding unit.

A frequency band retained before and after switching of a feeding unit need not be received by the same radiator pattern. For example, a signal of the second frequency band (e.g., a GPS signal band) may be received by the radiator pattern 215*b* before switching of a feeding unit, but it may be received by the modified radiator pattern 215*c* after switching of a feeding unit. A signal of a fourth frequency band (e.g., an LTE high frequency band) may be received by the modified radiator pattern 215*b*.

Figure 4:
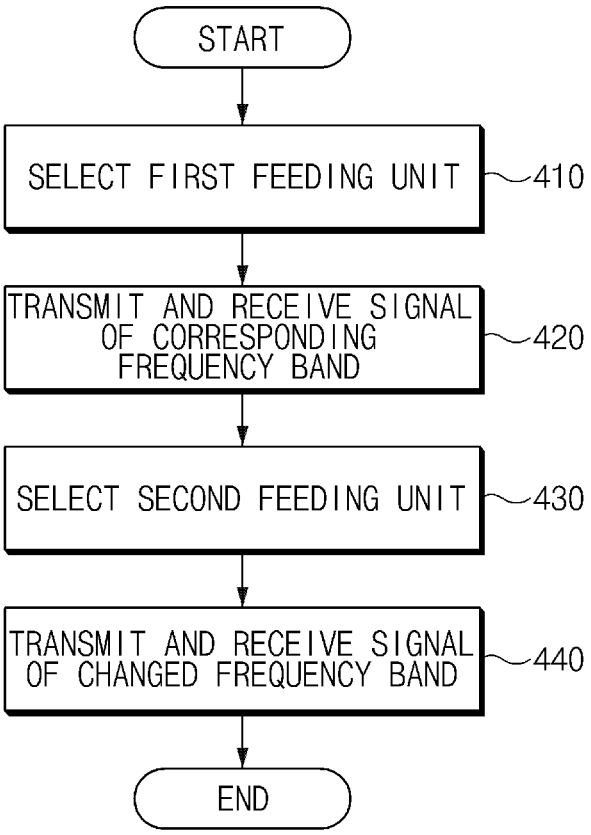
FIG. 4 is a flowchart illustrating a method for selecting a feeding unit using a switching unit, according to an embodiment of the present invention.

FIG. 4 is a flowchart illustrating a method for selecting a feeding unit using a switching unit, according to an embodiment of the present invention.

Referring to FIG. 4, in step 410, an electronic device (e.g., an electronic device equipped with a multi-band antenna 200) may select a first feeding unit (e.g., a feeding unit 220*a*) from a plurality of feeding units (e.g., a feeding units 220*a* and 220*b*) using a switch (e.g., a switching unit 230). The first feeding unit may be coupled with an antenna radiator 210 through a first contact point (e.g., a contact point 210*a*).

A shape or length of each radiator pattern may be determined according to a position of the first contact point to which power is supplied. For example, the length of the first radiator pattern 215*a* may be from the first contact point to an end portion of the first radiator pattern 215*a*.

In step 420, a plurality of radiator patterns (e.g., radiator patterns 215*a* to 215*c*) transmits and receives signals of frequency bands corresponding to the determined shapes or lengths. A radiator pattern having the longest length, from among the plurality of radiator patterns, transmits and receives a signal of the lowest frequency band. A radiator pattern having the shortest length, from among the plurality of radiator patterns, transmits and receives a signal of the highest frequency band.

In step 430, the electronic device selects a second feeding unit (e.g., a feeding unit 220*b*) from the plurality of feeding units (e.g., feeding units 220*a* and 220*b*) using the switch (e.g., a switching unit 230). The second feeding unit may be coupled with the antenna radiator 210 through a second contact point (e.g., a contact point 210*b*) different from the first contact point.

A shape or length of each radiator pattern may be determined according to a position of the second contact point to which power is supplied. For example, the length of the first radiator pattern 215*a* may be from the second contact point to an end portion of the first radiator pattern 215*a*.

In step 440, the plurality of radiator patterns transmits and receives signals of frequency bands corresponding to the changed shapes or lengths. In each radiator pattern, a corresponding frequency band may be changed before and after changing of a feeding unit. For example, if the first radiator pattern 215*a* corresponds to a first frequency band (e.g., a 900 to 930 MHz band) before changing of a feeding unit, it may operate at a second frequency band (e.g., a 1000 to 1050 MHz band) different from the first frequency band after changing of a feeding unit.

At least one of frequency bands may be retained without modification even though a feeding unit is changed by the switching unit 230.

Where first to third radiator patterns correspond to first to third frequency bands before changing of a feeding unit, the first to third radiator patterns may operate with at least one frequency band without modification after changing of a feeding unit. For example, even though the first radiator pattern 215*a* and the second radiator pattern 215*b* correspond to a fourth frequency band and a fifth frequency band, not a first frequency band and a second frequency band, a shape or length of the third radiator pattern may be adjusted so as to correspond to the second frequency band which corresponds to the second radiator pattern 215*b* before changing of a feeding unit.

Figure 5:
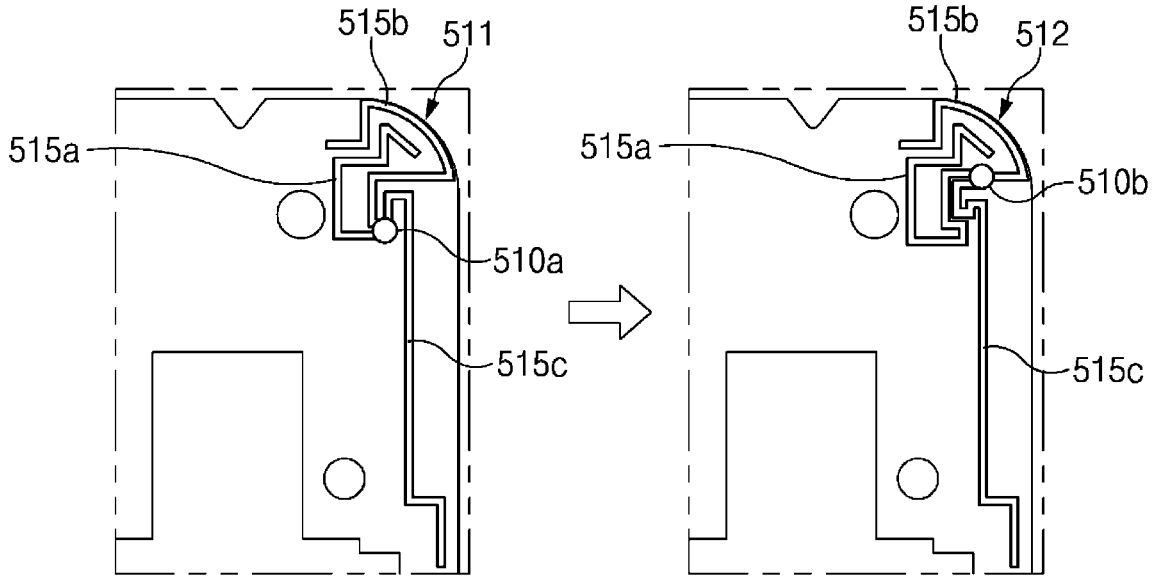
FIG. 5 is a diagram illustrating an antenna radiator, according to an embodiment of the present invention.

FIG. 5 is a diagram illustrating an antenna radiator, according to an embodiment of the present invention.

Each of antenna radiators 511 and 512 may include first to third radiator patterns 515*a* to 515*c*. The first to third radiator patterns 515*a* to 515*c* may be implemented inside or outside an electronic device so as to have a specific shape or length. However, radiator patterns illustrated in FIG. 5 are merely examples, and may be modified or changed according to a communication environment or a design environment.

The antenna radiator 511 may have a shape in which a first feeding unit (e.g., a feeding unit 220*a*) is selected. Where the first feeding unit is selected by a switching unit 230, power may be supplied through a first contact point 510*a*. Shapes and lengths of first to third radiator patterns 515*a* to 515*c* may be determined according to a position of the first contact point 510*a*. A length of each radiator pattern may correspond to a length from the first contact point 510*a* to an end portion of a corresponding radiator pattern. Each radiator pattern transmits and receives a signal of at least one frequency band corresponding to its shape or length.

The antenna radiator 512 may have a shape in which a second feeding unit (e.g., a feeding unit 220*b*) is selected. Where the second feeding unit is selected by the switching unit 230, power may be supplied through a second contact point 510*b*. Shapes and lengths of the first to third radiator patterns 515*a* to 515*c* may be determined according to a position of the second contact point 510*b*. A changed length of each radiator pattern may correspond to a length from the second contact point 510*b* to an end portion of a corresponding radiator pattern. Where a shape or length of each radiator pattern is changed, each radiator pattern may operate at a frequency band that is different from a corresponding frequency band before changing. Even though a feeding unit is changed, the antenna radiator 512 may retain at least one of corresponding frequency bands before changing of a feeding unit without modification.

At least one of a plurality of radiator patterns may correspond to a frequency band for transmitting and receiving a GPS, Bluetooth® (BT®), or Wireless-Fidelity® (Wi-Fi®) signal, and may continuously transmit and receive the GPS, BT®, or Wi-Fi® signal even though a feeding unit is changed by a switching unit 230.

It may be possible to retain an LTE carrier aggregation (CA) state or an LTE multi-carrier state even though a feeding unit is changed by the switching unit 230. Even though a feeding unit is changed by the switching unit 230, a multi-band antenna 200 may retain two or more frequency bands for use in the LTE CA technology without modification, thereby making it possible to maintain a communication speed at an equal level before and after changing of a feeding unit. The LTE multi-carrier state may correspond to a state where a frequency band is selected and used, in which data traffic is relatively smooth, from among two or more frequency bands. Even though a feeding unit is changed by the switching unit 230, the multi-band antenna 200 may retain two or more frequency bands for use in the LTE multi-carrier technology without modification, thereby making it possible to maintain a communication speed at an equal level before and after changing of a feeding unit.

Figure 6A:
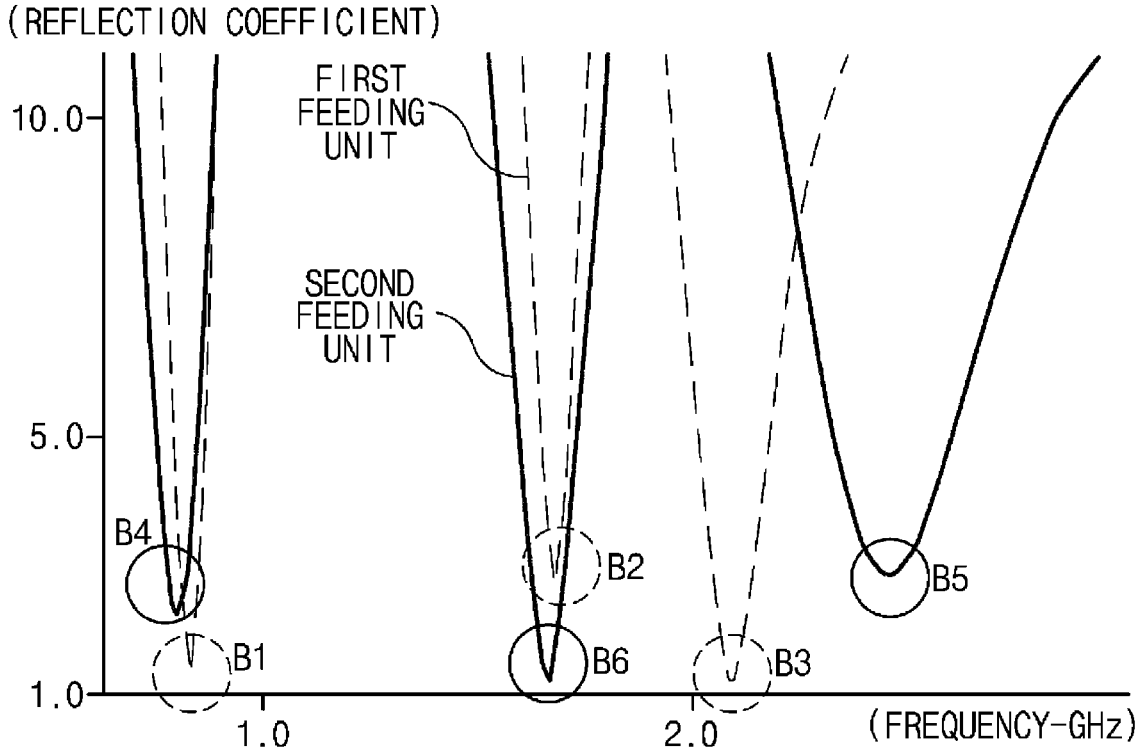

FIG. 6A is a graph illustrating a variation in an input reflection coefficient due to a frequency variation and FIG. 6B is a table of digitized antenna communication efficiencies before and after changing of a feeding unit, according to an embodiment of the present invention.

As illustrated in FIG. 6A, an input reflection coefficient varies according to a frequency of an antenna. It may be understood that a signal of a corresponding frequency band is received more efficiently as an input reflection coefficient becomes smaller. In the case where a switching unit 230 selects a first feeding unit 220*a*, first to third radiator patterns 215*a* to 215*c* may operate at frequency bands B1 to B3, respectively. An input reflection coefficient of an antenna radiator 210 may be illustrated as having a relatively small value at the frequency bands B1 and B3.

Where a switching unit selects a second feeding unit 220*b*, a contact point to which power is supplied may be changed, so shapes or lengths of the first to third radiator patterns 215*a* to 215*c* may be changed. After a feeding unit is changed, the first to third radiator patterns 215*a* to 215*c* operate at frequency bands B4 to B6, respectively. The second radiator pattern 215*b* operates at the frequency band B5 which is higher than the frequency band B2. The third radiator pattern 215*c* operates at the frequency band B6 which is lower than the frequency band B5 after changing of a feeding unit. The switching unit 230 may change a position of a contact point and a feeding unit to which power is supplied, thereby making it possible for an antenna to operate at various frequency bands.

At least one of frequency bands corresponding to a plurality of radiator patterns 215 before changing of a feeding unit may be retained without modification even after changing of a feeding unit. In FIG. 6A, for example, the second radiator pattern 215*b* may operate at the frequency band B2 before a feeding unit is changed, but may operate at the frequency band B5 that is higher than the frequency band B2 after a feeding unit is changed. In contrast, after a feeding unit is changed, the third radiator pattern 215*c* transmits and receives data on the frequency band B6 that is the same as or similar to the frequency band B2. A multi-band antenna 200 may continuously transmit and receive a signal of the frequency band B2 (or the frequency band B6) before and after changing of a feeding unit.

Referring to FIG. 6B, where a first feeding unit 220*a* is selected, antenna radiation efficiency may be relatively high at frequency bands B1 to B3. The frequency bands B1 to B3 may correspond to first to third radiator patterns before changing of a feeding unit. Where a second feeding unit 220*b* is selected by a switching unit 230, antenna radiation efficiency may be relatively high at frequency bands B4 to B6. Frequency bands B4 to B6 may correspond to the first to third radiator patterns 215*a* to 215*c* of which the shapes or lengths are changed after changing of a feeding unit. The frequency band B2 (or the frequency band B6) may be covered by the multi-band antenna 200 even after a feeding unit is changed.

FIGS. 7A-7D are diagrams illustrating a multi-band antenna, according to an embodiment of the present invention.

Figure 7A:
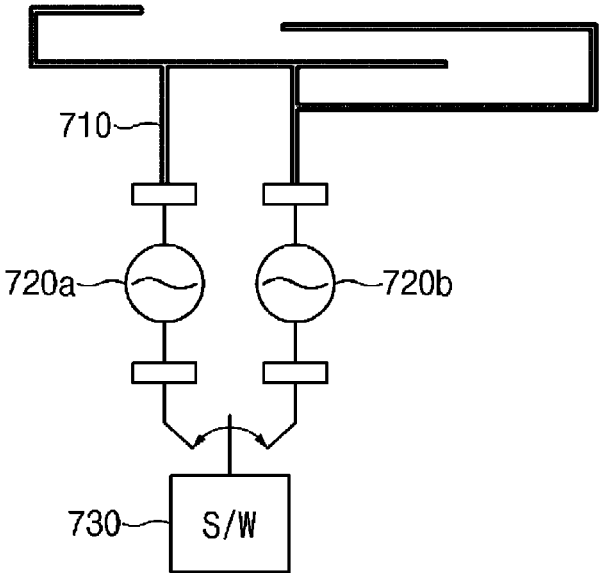
FIGS. 7A-7D are diagrams illustrating a multi-band antenna, according to an FIGS. 7A-7D are diagrams illustrating a multi-band antenna, according to an embodiment of the present invention.

FIG. 7A illustrates a monopole type multi-band antenna. The monopole type multi-band antenna may correspond to an inverted L type multi-band antenna to which a bent shape of a radiator pattern is applied. The monopole type multi-band antenna may be configured such that a separate ground unit is not connected to a first or second feeding unit, 720*a*, 720*b*. Where at least one of the first feeding unit 720*a* or the second feeding unit 720*b* is selected by the switching unit 730, each radiator pattern included in an antenna radiator 710 may operate as a monopole type antenna including one feeding unit and one branch.

Figure 7B:
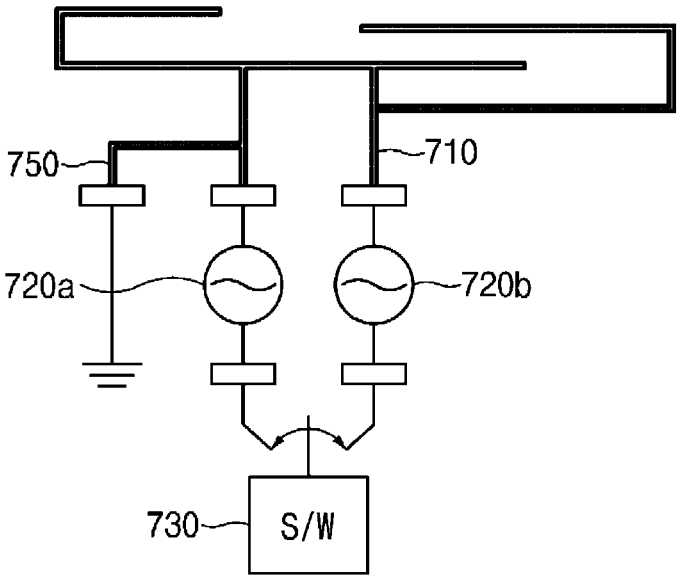
Figure 7C:
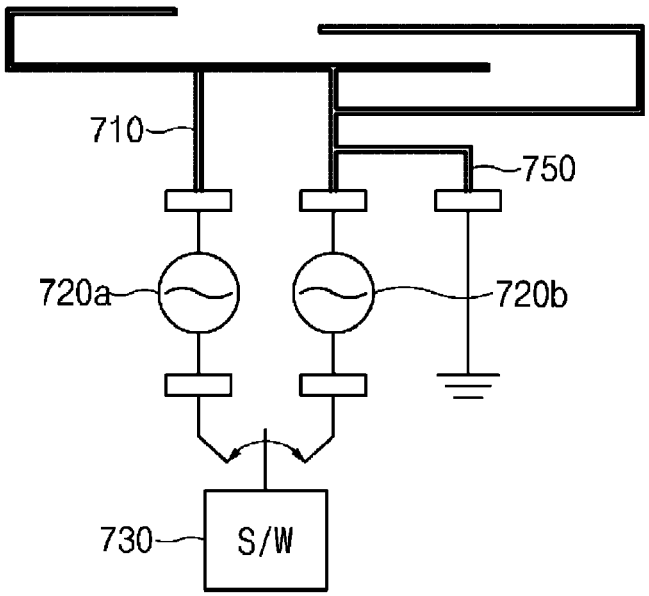

FIGS. 7B and 7C illustrate semi-inverted F type multi-band antennas. A semi-inverted F type multi-band antenna may have a shape in which one monopole type antenna and one inverted F type antenna are combined. The semi-inverted F type multi-band antenna may include a ground unit 750 that is connected to one of the first feeding unit 720*a* or the second feeding unit 720*b*. Referring to FIG. 7B, in the case where a first feeding unit 720*a* is selected by the switching unit 730, each radiator pattern included in the antenna radiator 710 operates as an inverted F type antenna that includes the first feeding unit 720*a*, the ground unit 750, and a branch. Where a second feeding unit 720*b* is selected by the switching unit 730, each radiator pattern included in the antenna radiator 710 may operate as a monopole type antenna that includes the second feeding unit 720*b* and one branch.

Referring to FIG. 7C, where the first feeding unit 720*a* is selected by the switching unit 730, each radiator pattern included in the antenna radiator 710 may operate as a monopole type antenna that includes the first feeding unit 720*a* and one branch. Where the second feeding unit 720*b* is selected by the switching unit 730, each radiator pattern included in the antenna radiator 710 operates as an inverted F type antenna that includes the second feeding unit 720*b*, the ground unit 750, and one branch.

Figure 7D:
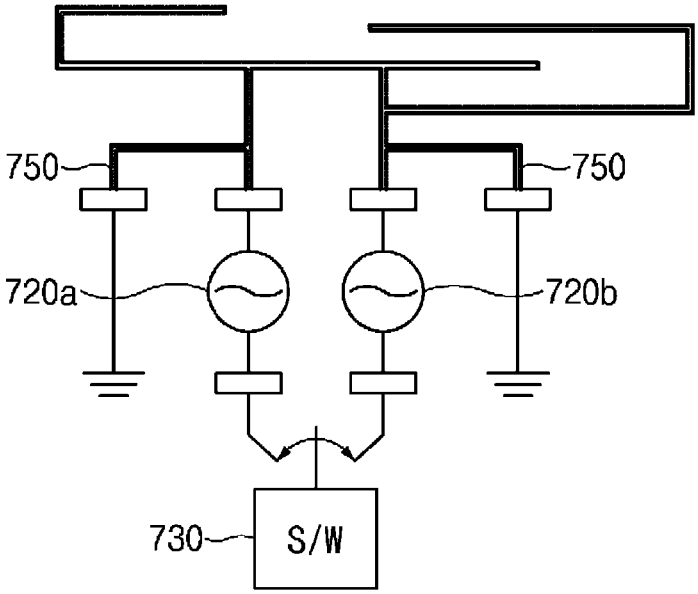

FIG. 7D illustrates an inverted F type multi-band antenna. An inverted F type multi-band antenna may include ground units 750 that are connected to first and second feeding units 720*a*, 720*b*, respectively. Where a first feeding unit or a second feeding unit is selected by the switching unit 730, each radiator pattern included in the antenna radiator 710 operates as an inverted F type antenna that includes a feeding unit, the ground unit 750, and one branch.

The multi-band antenna 200 is not limited to the shapes that are illustrated in FIGS. 7A-7D. For example, the multi-band antenna 200 may be configured such that various current paths can be formed. A first or second feeding unit may be implemented so as to have a short-circuit state. Furthermore, the first or second feeding unit may be grounded at a short-circuit state to form a new current path. Various current paths may be used in various shapes for antenna matching and the like.

Figure 8:
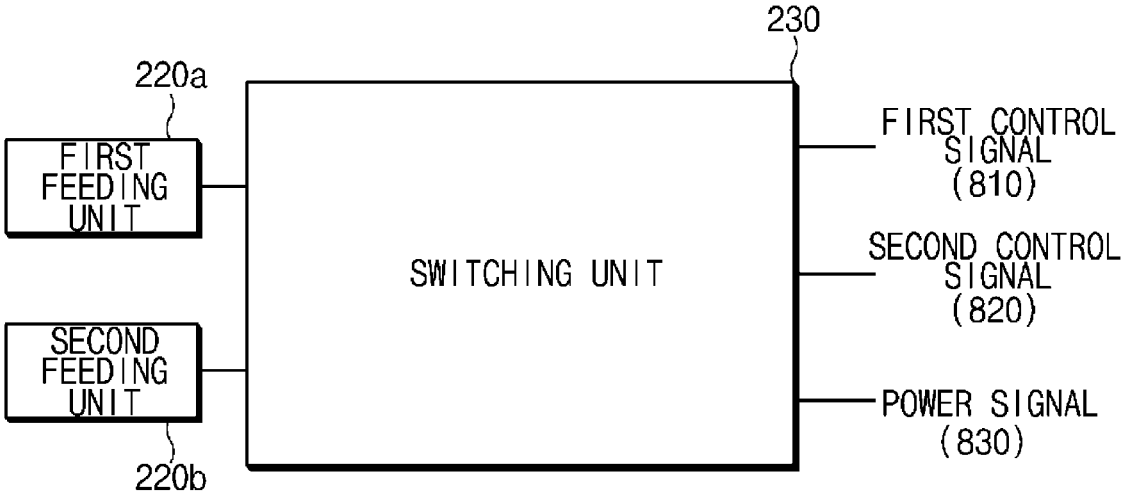
FIG. 8 is a diagram illustrating a circuit of a switching unit, according to an embodiment of the present invention.

FIG. 8 is a diagram illustrating a circuit of a switching unit, according to an embodiment of the present invention.

Referring to FIG. 8, the switching unit 230 operates in response to a first control signal 810 or a second control signal 820 that a circuit unit (e.g., an RF module) provides. The switching unit 230 selects the first feeding unit 220*a* or the second feeding unit 220*b* in response to the first control signal 810 or the second control signal 820. The switching unit 230 connects the selected feeding unit to a power signal 830 that an internal circuit of an electronic device provides. Where the first feeding unit 220*a* or the second feeding unit 220*b* is provided with the power signal 830, the first feeding unit 220*a* or the second feeding unit 220*b* provides the power signal to an antenna radiator. If a position of a contact point to which power is supplied is changed due to a change of a feeding unit, frequency bands corresponding to radiator patterns may be changed.

Figure 9:
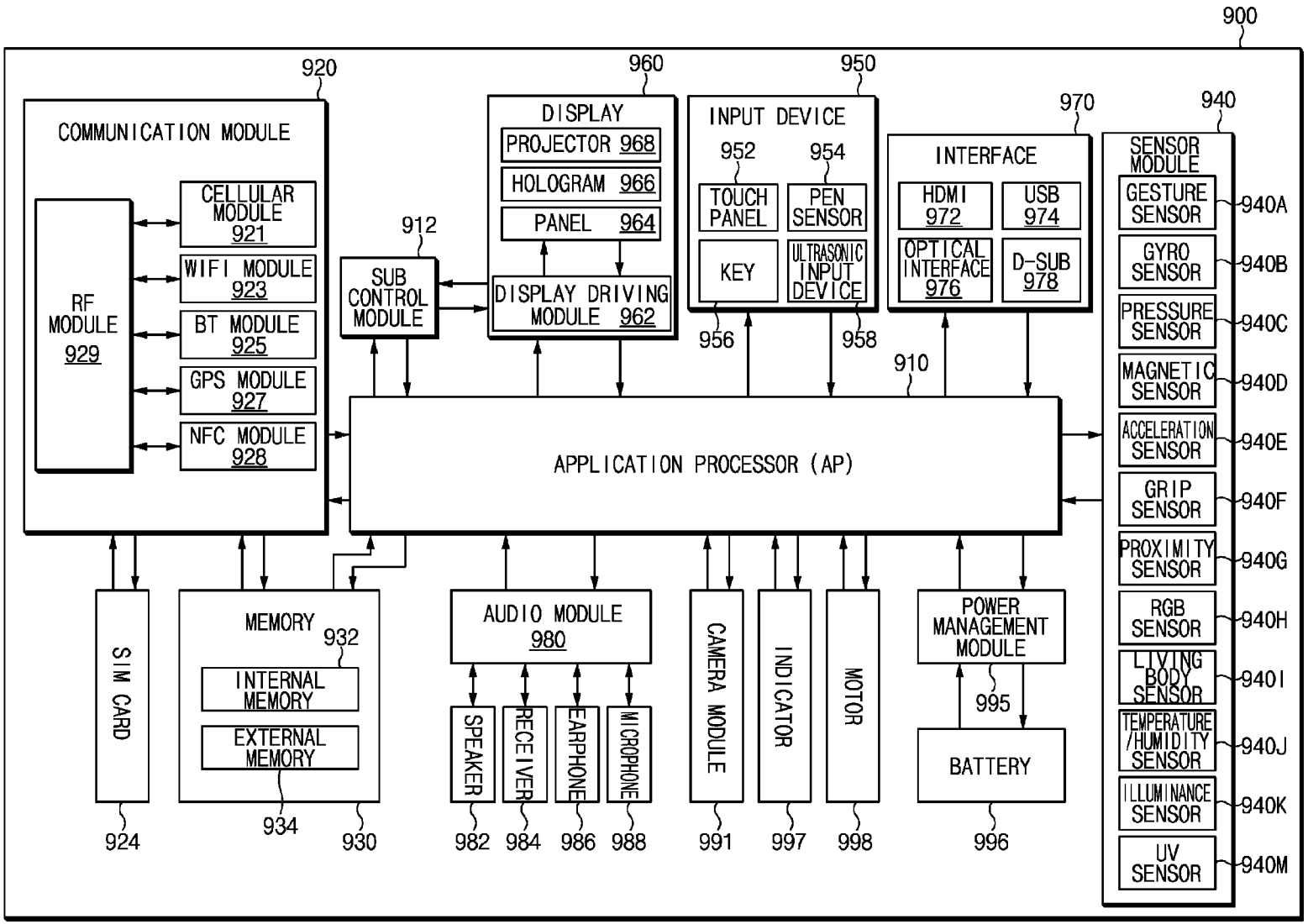
FIG. 9 is a diagram illustrating an electronic device, according to an embodiment of the present invention.

FIG. 9 is a diagram illustrating an electronic device, according to an embodiment of the present invention.

Referring to FIG. 9, an electronic device 900 may include one or more application processors (AP) 910, a communication module 920, a subscriber identification module (SIM) card 924, a memory 930, a sensor module 940, an input device 950, a display 960, an interface 970, an audio module 980, a camera module 991, a power management module 995, a battery 996, an indicator 997, and a motor 998.

The AP 910 drives an operating system (OS) or an application to control a plurality of hardware or software components connected to the AP 910 and processes and computes a variety of data including multimedia data. The AP 910 may be implemented with a System on Chip (SoC), for example. The AP 910 may further include a graphic processing unit (GPU).

The communication module 920 transmits and receives data when there are conveyed communications between other electronic devices connected with the electronic device 900 through a network. The communication module 920 includes a cellular module 921, a Wi-Fi® module 923, a BT® module 925, a GPS module 927, a near field communication (NFC) module 928, and a radio frequency (RF) module 929.

The cellular module 921 provides voice communication, video communication, a character service, an Internet service or the like through a communication network (e.g., an LTE, an LTE-A, a CDMA, a WCDMA, a UMTS, a WiBro, a GSM, or the like). Also, the cellular module 921 may perform discrimination and authentication of an electronic device within a communication network using a subscriber identification module (e.g., a SIM card 924), for example. The cellular module 921 may perform at least a portion of functions that the AP 910 provides. For example, the cellular module 921 may perform at least a portion of a multimedia control function.

The cellular module 921 may include a communication processor (CP). Also, the cellular module 921 may be implemented with, for example, an SoC. Although components such as the cellular module 921 (e.g., a communication processor), the memory 930, the power management module 995, and the like are illustrated as being components independent of the AP 910, the AP 910 may be implemented to include at least a portion (e.g., a cellular module 921) of the above components.

The AP 910 or the cellular module 921 (e.g., a communication processor) may load and process an instruction or data received from nonvolatile memories respectively connected thereto or from at least one of other elements at the nonvolatile memory. Also, the AP 910 or the cellular module 921 may store data received from at least one of other elements or generated by at least one of other elements at a nonvolatile memory.

Each of the Wi-Fi® module 923, the BT® module 925, the GPS module 927, and the NFC module 928 may include a processor for processing data exchanged through a corresponding module, for example. The cellular module 921, the Wi-Fi® module 923, the BT® module 925, the GPS module 927, and the NFC module 928 are separate blocks, respectively. At least a portion (e.g., two or more components) of the cellular module 921, the Wi-Fi® module 923, the BT® module 925, the GPS module 927, and the NFC module 928 may be included within one Integrated Circuit (IC) or an IC package. For example, at least a portion (e.g., a communication processor corresponding to the cellular module 921 and a Wi-Fi® processor corresponding to the Wi-Fi® module 923) of communication processors corresponding to the cellular module 921, the Wi-Fi® module 923, the BT® module 925, the GPS module 927, and the NFC module 928 may be implemented with one SoC.

The RF module 929 transmits and receives data, for example, an RF signal. Although not illustrated, the RF module 929 may include a transceiver, a power amplifier module (PAM), a frequency filter, or low noise amplifier (LNA). Also, the RF module 929 may further include the following part for transmitting and receiving an electromagnetic wave in a space in wireless communication: a conductor or a conducting wire. The cellular module 921, the Wi-Fi® module 923, the BT® module 925, the GPS module 927, and the NFC module 928 are implemented to share one RF module 929. At least one of the cellular module 921, the Wi-Fi® module 923, the BT® module 925, the GPS module 927, or the NFC module 928 may transmit and receive an RF signal through a separate RF module.

The SIM card 924 may be inserted to a slot formed at a specific position of the electronic device. The SIM card 924 may include unique identify information (e.g., integrated circuit card identifier (ICCID)) or subscriber information (e.g., integrated mobile subscriber identity (IMSI)).

The memory 930 may include an embedded memory 932 or an external memory 934. For example, the embedded memory 932 may include at least one of a volatile memory (e.g., a dynamic random access memory (DRAM), a static RAM (SRAM), or a synchronous DRAM (SDRAM)) and a nonvolatile memory (e.g., a one-time programmable read only memory (OTPROM), a programmable ROM (PROM), an erasable and programmable ROM (EPROM), an electrically erasable and programmable ROM (EEPROM), a mask ROM, a flash ROM, a NAND flash memory, or a NOR flash memory).

The internal memory 932 may be a solid state drive (SSD). The external memory 934 may include a flash drive, for example, compact flash (CF), secure digital (SD), micro secure digital (Micro-SD), mini secure digital (Mini-SD), extreme digital (xD) or a memory stick. The external memory 934 may be functionally connected to the electronic device 900 through various interfaces. The electronic device 900 may further include a storage device (or a storage medium), such as a hard drive.

The sensor module 940 measures a physical quantity or detects an operational state of the electronic device 900. The sensor module 940 converts the measured or detected information to an electric signal. The sensor module 940 includes at least one of a gesture sensor 940A, a gyro sensor 940B, a pressure sensor 940C, a magnetic sensor 940D, an acceleration sensor 940E, a grip sensor 940F, a proximity sensor 940G, a color sensor 940H (e.g., red, green, blue (RGB) sensor), a living body sensor 940I, a temperature/humidity sensor 940J, an illuminance sensor 940K, or an UV sensor 940M. Although not illustrated, additionally or generally, the sensor module 940 may further include, for example, an E-nose sensor, an electromyography sensor (EMG) sensor, an electroencephalogram (EEG) sensor, an electrocardiogram (ECG) sensor, a photoplethysmographic (PPG) sensor, an infrared (IR) sensor, an iris sensor, a fingerprint sensor, and the like. The sensor module 940 may further include a control circuit for controlling at least one or more sensors included therein.

The input device 950 includes a touch panel 952, a (digital) pen sensor 954, a key 956, or an ultrasonic input unit 958. The touch panel 952 recognizes a touch input using at least one of capacitive, resistive, infrared and ultrasonic detecting methods. Also, the touch panel 952 may further include a control circuit. When using the capacitive detecting method, a physical contact recognition or proximity recognition is allowed. The touch panel 952 may further include a tactile layer. In this case, the touch panel 952 may provide a tactile reaction to a user. The touch panel 952 may generate a touch event associated with execution of a specific function using position associated information.

The (digital) pen sensor 954 may be implemented in a similar or same manner as the method of receiving a touch input of a user or may be implemented using an additional sheet for recognition. The key 956 may include, for example, a physical button, an optical key, a keypad, and the like. The ultrasonic input device 958, which is an input device for generating an ultrasonic signal, may enable the electronic device 900 to sense detect a sound wave through a microphone (e.g., a microphone 988) so as to identify data, wherein the ultrasonic input device 958 is capable of wireless recognition. The electronic device 900 may use the communication module 920 so as to receive a user input from an external device (e.g., a computer or server) connected to the communication module 920.

The display 960 may include a panel 962, a hologram device 964, or a projector 966. The panel 962 may be, for example, flexible, transparent or wearable. The panel 962 and the touch panel 952 may be integrated into a single module. The hologram device 964 may project a stereoscopic image in a space using a light interference phenomenon. The projector 966 may project light onto a screen so as to display an image. The screen may be arranged in the inside or the outside of the electronic device 900. The display 960 may further include a control circuit for controlling the panel 962, the hologram device 964, or the projector 966.

The interface 970 may include, for example, an HDMI (high-definition multimedia interface) 972, a USB (universal serial bus) 974, an optical interface 976, or a D-sub (D-subminiature) 978. Additionally or generally, the interface 970 may include, for example, a mobile high definition link (MHL) interface, a SD card/multi-media card (MMC) interface, or an infrared data association (IrDA) standard interface.

The audio module 980 may convert a sound and an electric signal in dual directions. At least a portion of the audio module 980 may process, for example, sound information that is input or output through a speaker 982, a receiver 984, an earphone 986, or a microphone 988.

The camera module 991, for shooting a still image or a video, may include at least one image sensor (e.g., a front sensor or a rear sensor), a lens, an image signal processor (ISP), or a flash (e.g., an LED or a xenon lamp).

The power management module 995 may manage power of the electronic device 900. Although not illustrated, a power management integrated circuit (PMIC) a charger IC, or a battery gauge may be included in the power management module 995.

The PMIC may be mounted on an integrated circuit or a SoC semiconductor. A charging method may be a wired charging method and a wireless charging method. The charger IC may charge a battery, and may prevent an overvoltage or an overcurrent from being introduced from a charger. The charger IC may include a charger IC for at least one of the wired charging method and the wireless charging method. The wireless charging method may include, for example, a magnetic resonance method, a magnetic induction method or an electromagnetic method, and may include an additional circuit, for example, a coil loop, a resonant circuit, or a rectifier, and the like.

The battery gauge measures, for example, a remaining capacity of the battery 996 and a voltage, current or temperature thereof while the battery is charged. The battery 996 stores or generates electricity, and supplies power to the electronic device 900 using the stored or generated electricity. The battery 996 may include, for example, a rechargeable battery or a solar battery.

The indicator 997 displays a specific state of the electronic device 900 or a portion thereof (e.g., the AP 910), such as a booting state, a message state, a charging state, and the like. The motor 998 converts an electrical signal into a mechanical vibration. Although not illustrated, a processing device (e.g., a GPU) for supporting a mobile TV may be included in the electronic device 900. The processing device for supporting a mobile TV may process media data according to the standards of DMB, digital video broadcasting (DVB) or media flow.

Each of the above-mentioned elements of the electronic device according to various embodiments of the present invention may be configured with one or more components, and the names of the elements may be changed according to the type of the electronic device. The electronic device ac may include at least one of the above-mentioned elements, and some elements may be omitted or other additional elements may be added. Furthermore, some of the elements of the electronic device may be combined with each other so as to form one entity, so that the functions of the elements may be performed in the same manner as before the combination.

A module or a programming module may include at least one of the above elements, or a portion of the above elements may be omitted, or additional other elements may be further included. Operations performed by a module, a programming module, or other elements may be executed sequentially, in parallel, repeatedly, or in a heuristic method. Also, a portion of operations may be executed in different sequences, omitted, or other operations may be added.

While the present invention has been shown and described with reference to certain embodiments thereof, it should be understood by those skilled in the art that many variations and modifications of the method and apparatus described herein will still fall within the spirit and scope of the present invention as defined in the appended claims and their equivalents.

What is claimed is:

1. A multi-band antenna comprising:

an antenna radiator including a plurality of radiator patterns configured to operate according to different frequency bands;

a plurality of feeding units respectively connected to different contact points of the antenna radiator for connecting feeding units of the plurality of feeding units to at least one radiator pattern included in the plurality of radiator patterns;

a switching unit switching between the plurality of feeding units for selecting a feeding unit of the plurality of feeding units; and a circuit unit configured to control the switching unit, wherein the selected feeding unit connects at least one radiator pattern included in the plurality of radiator patterns to the circuit unit, wherein when a feeding unit is changed by the switching unit, the plurality of radiator patterns continuously correspond to at least one of the different frequency bands, wherein a first radiator pattern, a second radiator pattern, and a third radiator pattern of the plurality of radiator patterns corresponds to a first frequency band, a second frequency band, and a third frequency band, respectively, prior to changing the feeding unit, wherein the first radiator pattern, the second radiator pattern, and the third radiator pattern corresponds to a fourth frequency band, a fifth frequency band, and a six frequency band, respectively, subsequent to changing the feeding unit, and wherein the sixth frequency band is broader than or equal to one of the first frequency band, the second frequency band, and the third frequency band.

2. The multi-band antenna of claim 1, wherein a length of each of the plurality of radiator patterns is changed if a feeding unit is changed by the switching unit.

3. The multi-band antenna of claim 1, further comprising:

a ground unit that is connected to the antenna radiator.

4. The multi-band antenna of claim 3, wherein the ground unit is connected to at least one of the different contact points.

5. The multi-band antenna of claim 1, wherein the plurality of feeding units are short-circuited to each other.

6. The multi-band antenna of claim 1, wherein the antenna radiator is selected from the group consisting of a monopole type, an inverted-F (IFA) type, or a semi-IFA type, based on an operation of the switching unit.

7. The multi-band antenna of claim 1, wherein at least one of the plurality of radiator patterns operate within a frequency band for transmitting and receiving one of a GPS signal, a Bluetooth signal, and a Wi-Fi signal and continues to transmit and receive one of the GPS signal, the Bluetooth signal, or the Wi-Fi signal when a feeding unit is changed by the switching unit.

8. The multi-band antenna of claim 1, wherein the multi-band antenna retains one of an LTE carrier aggregation (CA) state and an LTE multi-carrier state when a feeding unit is changed by the switching unit.

9. The multi-band antenna of claim 1, further comprising:

a matching unit in operable communication with the plurality of feeding units and the switching unit.

10. The multi-band antenna of claim 9, wherein the matching unit monitors at least one of capacitance, resistance, reactance and a combination thereof associated with one of the plurality of feeding units and the switching unit for adjusting impedance of the plurality of feeding units and the switching unit in such a way that each radiator pattern of the plurality of radiator patterns operates at a specific frequency band.

11. The multi-band antenna of claim 1, wherein, subsequent to the switching unit switching between feeding units, at least one radiator pattern included in the plurality of radiator patterns operates at a frequency that it operated at prior to the switching unit switching between feeding units and at least one other radiator pattern of the plurality of radiator patterns operates at a frequency that is different from a frequency that it operated at prior to the switching unit switching between feeding units.

12. An electronic device which includes a multi-band antenna, the multi-band antenna comprising:

an antenna radiator including a plurality of radiator patterns configured to operate according to different frequency bands;

a plurality of feeding units respectively connected to different contact points of the antenna radiator for connecting feeding units of the plurality of feeding units to at least one radiator pattern included in the plurality of radiator patterns;

a switching unit switching between the plurality of feeding units for selecting a feeding unit of the plurality of feeding units; and a circuit unit configured to control the switching unit, wherein the selected feeding unit connects at least one radiator pattern included in the plurality of radiator patterns to the circuit unit, wherein when a feeding unit is changed by the switching unit, the plurality of radiator patterns continuously correspond to at least one of the different frequency bands, wherein a first radiator pattern, a second radiator pattern, and a third radiator pattern of the plurality of radiator patterns corresponds to a first frequency band, a second frequency band, and a third frequency band, respectively, prior to changing the feeding unit, wherein the first radiator pattern, the second radiator pattern, and the third radiator pattern corresponds to a fourth frequency band, a fifth frequency band, and a six frequency band, respectively, subsequent to changing the feeding unit, and wherein the sixth frequency band is broader than or equal to one of the first frequency band, the second frequency band, and the third frequency band.

13. The electronic device of claim 12, wherein, subsequent to the switching unit switching between feeding units, at least one radiator pattern included in the plurality of radiator patterns operates at a frequency that it operated at prior to the switching unit switching between feeding units and at least one other radiator pattern of the plurality of radiator patterns operates at a frequency that is different from a frequency that it operated at prior to the switching unit switching between feeding units.

* * * * *